United States Patent [19]

Anderson et al.

[11] 4,202,468

[45] May 13, 1980

[54] TICKET DISPENSER FOR ASSOCIATION WITH VENDING MACHINES

[76] Inventors: David R. Anderson, Rte. 4 Box 419, Delavan, Wis. 60115; Frank Kostka; Frank J. Kostka, both of 121 Southcote Rd., Riverside, Ill. 60546

[21] Appl. No.: 935,655

[22] Filed: Aug. 21, 1978

[51] Int. Cl.[2] ..... B65H 3/44

[52] U.S. Cl. ..... 221/93; 221/268; 225/23; 226/68

[58] Field of Search ..... 221/93, 94, 95, 268; 194/10, 2; 226/6, 67, 68, 151; 225/23

[56] References Cited

U.S. PATENT DOCUMENTS

| | | | |
|---|---|---|---|
| 2,639,148 | 5/1953 | Adams | 226/68 X |
| 3,010,607 | 11/1961 | Probasco | 221/93 |
| 3,058,639 | 10/1962 | Frederick | 194/2 X |
| 3,255,859 | 6/1966 | Simard et al. | 194/10 X |

*Primary Examiner*—Allen N. Knowles
*Attorney, Agent, or Firm*—McDougall, Hersh & Scott

[57] ABSTRACT

A ticket dispenser associated with a vending machine for vending goods or services of the type requiring the insertion of coins or tokens of a certain value in order to obtain the goods or services. The ticket dispenser provides for dispensing of a ticket by the machine in addition to the vending of the goods or services with the ticket being redeemable by the user of the machine for something of value in addition to the goods or services received. Ticket feeding pawls are employed for dispensing the tickets at a ticket delivery position, and the pawls are driven by coin operated actuating means of the machine so that the tickets are dispensed only upon insertion of sufficient coins or tokens. The pawls comprise a spring-loaded forward drive and locking pawl, and a spring-loaded retaining pawl. A ticket engaging baffle provides for simplified ticket removal.

5 Claims, 5 Drawing Figures

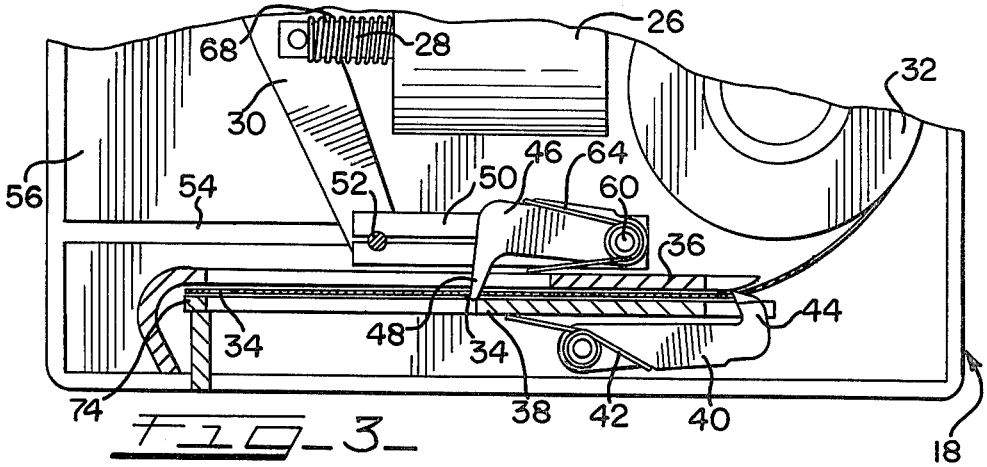
FIG. 3
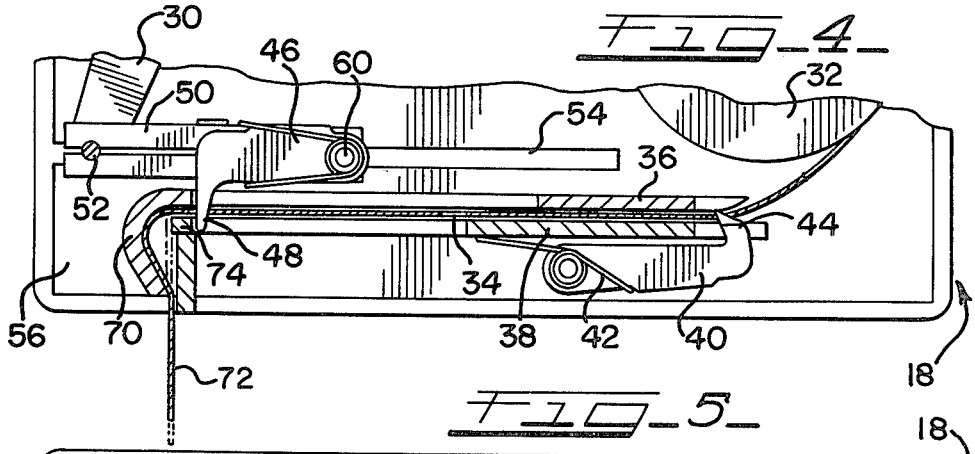
FIG. 4
FIG. 5
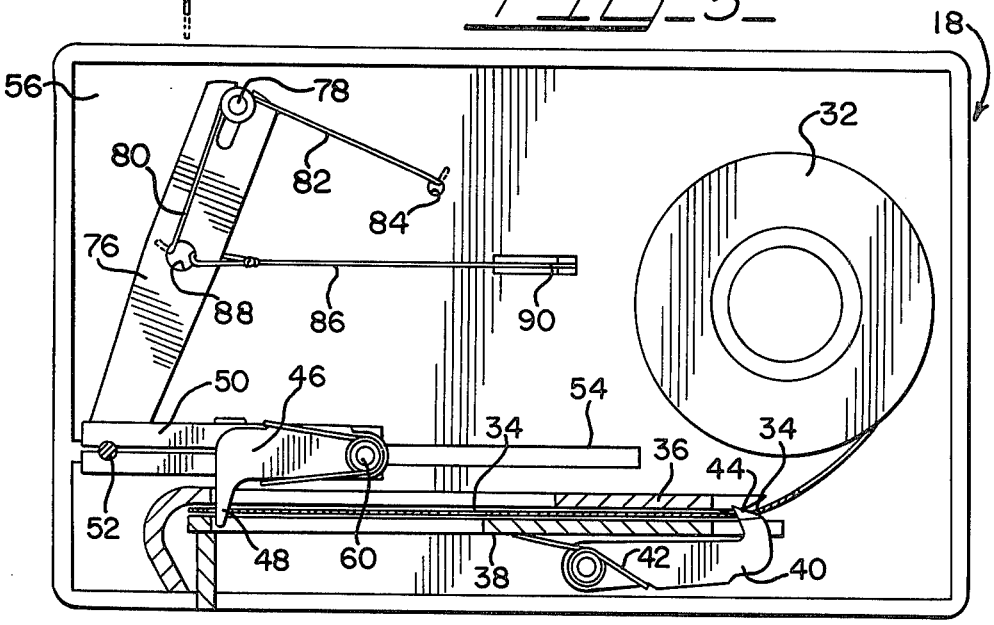

TICKET DISPENSER FOR ASSOCIATION WITH VENDING MACHINES

BACKGROUND OF THE INVENTION

Vending machines of the type normally utilized for the vending of goods and services are well known. Such machines utilize coin or token accepting mechanisms and are operable only when coins or tokens (hereinafter referred to as "checks") of a predetermined value have been inserted.

Techniques for encouraging the use of particular vending machines are highly desirable since the goods and services dispensed are usually available from many sources and competition is stiff. For example, self-service laundry operations may provide certain amenities in addition to the provision of check operating washing and drying machines. The owners of the facilities thereby hope to attract customers who might otherwise utilize services of a competitor.

A known system for attracting business has been the issuing of chances or the like with the holder of the chance being eligible for a prize when a drawing is held. In a typical operation, the chances would be issued in the form of tickets given to people entering the facility housing the vending machines. But the mere issuing of tickets to persons entering a facility can create problems since some individuals may accept tickets without actually patronizing the facility. In the absence of a person for controlling the dispensing of tickets, abuses are impossible to control. The use of personnel is itself a problem, however, since this increases costs to the extent that the system may be undesirable.

Kostka, et al. application Ser. No. 832,288, filed on Sept. 12, 1977 and entitled "Ticket Dispenser", now U.S. Pat. No. 4,140,259, involves the utilization of mechanisms associated with vending machines whereby tickets can be dispensed by the machines in addition to the vending of goods or services. The invention particularly involves a ticket dispensing means associated with a vending machine and operably connected to actuating means utilized for vending the goods or services. The actuating means will, in turn, be operable only upon the insertion of checks of a predetermined value. Since the ticket dispensing mechanisms will not operate except in conjunction with the actuating mechanisms of the vending machine, the ticket dispensing will occur only when a machine is actually used. Accordingly, only true patrons of the vending machine facility will be eligible for the prizes or other items of value upon the holding of a drawing or the like.

Summary Of The Invention

This invention involves a ticket dispensing means associated with a vending machine and operable in response to the operation of actuating means utilized for vending goods or services. The structure is also designed so that the ticket dispensing function can be limited to situations where checks of a predetermined value have been inserted in the vending machine.

The structure of the invention utilizes a drive arm having a first pawl means associated therewith. The drive arm is adapted to move the pawl means into position for engaging at least one opening in a strip of tickets and to thereafter move the pawl means forwardly for advancing the strip of tickets. This first pawl means, in the forward position, further serves to lock the strip of tickets thereby permitting removal of only a single ticket in each cycle of operation.

A second spring loaded retaining pawl is provided for holding the ticket strip in position during retracting movement of the first pawl means. The retaining pawl automatically engages openings in the ticket strip after the first pawl means has completed its forward movement so that during retracting movement of the first pawl means, the ticket strip will not be driven rearwardly.

The invention also utilizes a ticket engaging baffle which provides for simplified removal of tickets. The baffle drives the tickets into a configuration such that an individual ticket can be readily removed from a ticket strip. The effectiveness of the baffle is such that perforations between tickets can be eliminated if desired.

Description Of The Drawings

FIG. 3 is a fragmentary, horizontal, cross-sectional view illustrating the ticket dispensing mechanisms in preparation for the next dispensing operation;

FIG. 4 is a fragmentary, horizontal, cross-sectional view illustrating the ticket dispensing mechanism with a ticket in position for removal; and, FIG. 5 is a fragmentary, horizontal, cross-sectional view illustrating an alternative form of the invention.

Description Of The Preferred Embodiment

Figure 1:
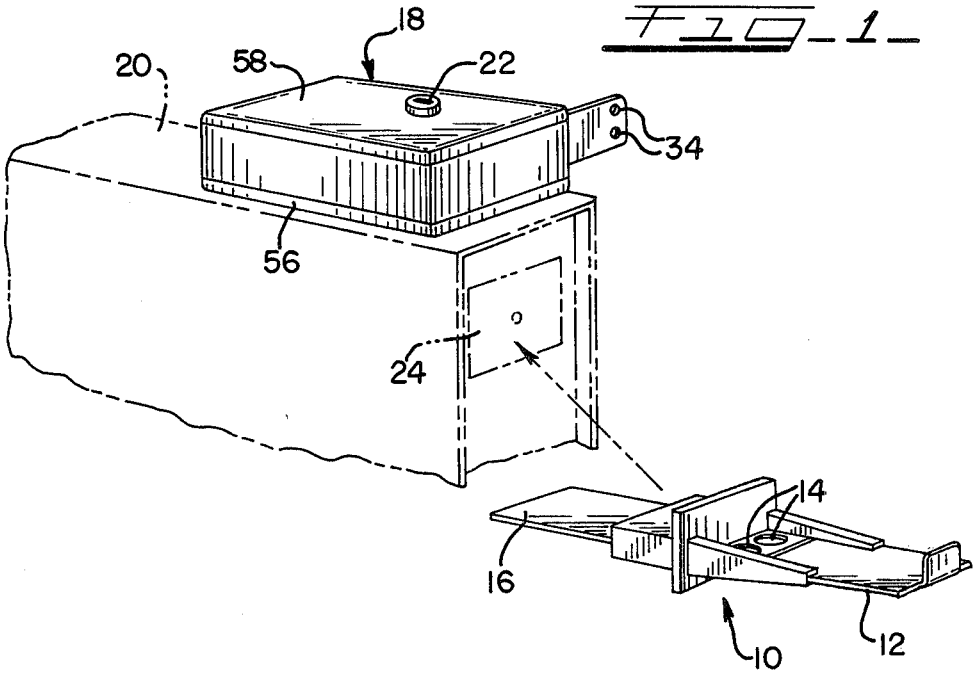
FIG. 1 is a perspective view of a vending machine coin chute in association with a ticket dispensing mechanism of the type contemplated by this invention.

In FIG. 1 of the drawings, the apparatus of this invention is shown associated with a vending machine. This apparatus finds particular application in association with vending machines of the type including a coin accepter 10, this accepter having a coin chute drive member 12 defining check receiving openings 14. In accordance with the standard operation of such devices, an actuating member is movable inwardly only when appropriate checks are inserted in the openings 14.

It will be understood that the invention contemplates the utilization of any standard coin accepting construction. The only requirement is that an actuating member is operated in response to the insertion of checks of a predetermined value. The actuation may take place directly and automatically due to operation of the machine as with the manually movable coin chute structure shown in the drawings. On the other hand, it is contemplated that a separate actuator, such as a push button, be made operable by the user of the machine upon insertion of the proper checks.

The ticket dispensing apparatus of this invention is located in a housing 18 which may be situated on the coin box 20 or at some other convenient location on a vending machine. A lock 22 is provided for permitting access to the housing 18 for repair purposes and for replenishing the supply of tickets. As indicated, the coin accepting construction 10 is conventionally positioned in an opening 24 so that this construction can be positioned immediately adjacent the ticket dispensing housing.

Figure 2:
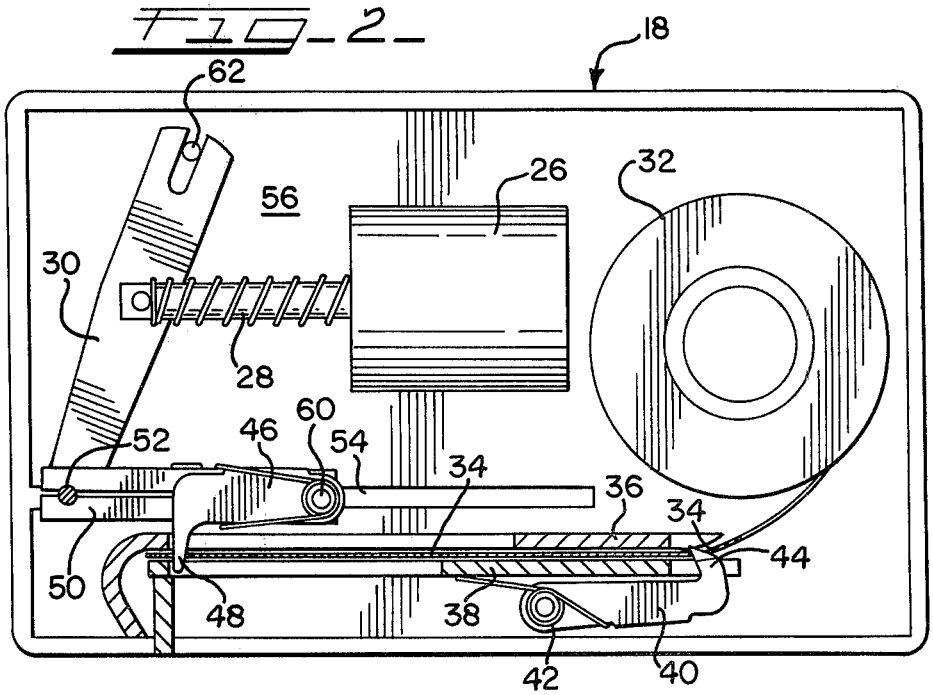
FIG. 2 is a horizontal, cross-sectional view illustrating the structure of the ticket dispensing mechanism after completion of a ticket dispensing operation.

In the embodiments of the invention shown in FIGS. 2, 3 and 4, a solenoid 26 is employed. This solenoid includes an armature 28 connected to drive arm 30. The solenoid is adapted to be operated in response to any suitable signal which is generated upon insertion of the proper amount of checks into a vending machine. As indicated, a signal may be generated when the drive member 12 of the coin chute has been moved inwardly to the extent permitted when checks are present in the openings 14. On the other hand, the signal for operating the solenoid may be generated simply by means detecting the insertion of a proper amount of checks or by a pushbutton which completes an electrical circuit upon receipt of a proper amount of checks in the machine.

The housing 18 supports a roll 32 of individual tickets. Openings 34 are formed at internals in the ticket strip. The individual tickets may be separated by perforated lines which simplifies tearing of a ticket off the strip.

Upper guide plate 36 and lower guide plate 38 define a passage for the ticket strip. A retaining pawl 40 is positioned beneath the plate 38 and spring 42 normally pivots this pawl in a counterclockwise direction. A pair of pawl fingers 44 are adapted to be received by openings 34 of the ticket strip.

A drive pawl 46 is shown in a forward position in FIGS. 2 and 4. A pair of pawl fingers 48 are associated with pawl 46, and these fingers are also adapted to be inserted in openings 34 of the ticket strip.

The pawl 46 is pivotally mounted on a support 50. A first pin 52 carried by the support is received in groove 54 defined by bottom wall 56 of the housing. The opposite end of pin 52 is received in a corresponding groove defined by the top wall 58 of the housing. Pin 60 provides pivoting support for the pawl 46, and this pin also has its ends received in opposed grooves 54. In this fashion, the support 50 is movable in a confined path within the housing.

FIGS. 2, 3 and 4 illustrate the sequence of operations involved. In FIG. 2, the structure is shown in the condition assumed after a ticket has been removed and before checks are inserted to permit dispensing of the next ticket. When the checks are inserted, the coin chute drive member 12 will be moved inwardly to actuate a switch or to otherwise develop a signal for operation of the solenoid 26.

FIG. 3 illustrates the condition with the solenoid energized whereby the arm 30 is pivoted by the action of armature 28, the arm being pivoted about pin 62. The support 50 and associated pawl 46 are moved rearwardly by the arm 30. It will be noted that the pawl is normally forced inwardly by the action of spring 64. In the course of rearward movement, the pawl is pivoted out of a forward opening 34 in opposition to spring 64, and the pawl is then dragged along the strip surface. When the next opening 34 is encountered, the spring forces pawl finger 48 into that opening.

In the meantime, pawl 40 prevents movement of the ticket strip. Thus, the drag of the pawl finger 48 over the strip surface will not push the strip rearwardly since pawl 40 serves a retaining function.

The spring 68 around armature 28 operates to return the arm 30 to its starting position when the solenoid 26 is de-energized. In a typical operation, the signal for the solenoid will simply be of a strength and duration sufficient to momentarily pull in the armature with the de-energization of the solenoid taking place immediately. Accordingly, the ticket dispensing operation will take place in a short time interval thereby causing no inconvenience to the user.

As shown in FIG. 4, the return of arm 30 results in driving of support 50 forwardly. Since pawl finger 48 is located in an opening 34, the ticket strip will automatically be indexed forwardly. In this connection, it will be noted that pawl finger 44 of pawl 40 defines a tapered end whereby this pawl is adapted to be driven downwardly in opposition to spring 42. Accordingly, the strip will ride over pawl finger 44. The movement of support 50 is controlled so that the forward position of the support will result in the next opening 34 of the ticket strip being located opposite finger 44. The spring 42 will then drive the pawl upwardly so that the finger 44 will enter the next opening 34. Accordingly, the structure will be set for the next ticket indexing operation.

The end of upper guide plate 36 is curved inwardly to provide a baffle section 70. This results in movement of the ticket strip in the path shown with the end 72 of a single ticket then being positioned outwardly of the housing 18. When the ticket is grasped by the user of the machine, the ticket is pulled over the edge 74 of the lower guide plate 38 as shown in dotted lines in FIG. 4. The edge 74 thus becomes a surface facilitating tearing of the single ticket from the strip.

It is contemplated that the edge 74 comprise a sharp corner or a serrated edge to facilitate removal of a single ticket. It has been found that with this arrangement, a single ticket can be removed even without providing perforations in the ticket strip. Thus, the utilization of the baffle design greatly improves the efficiency of the operation.

FIG. 5 illustrates a contemplated alternative of the invention. In this instance, the support 50 is attached to an arm 76 which is mounted for pivoting movement about pin 78. A spring has one arm 80 connected to arm 76, and the other arm 82 secured in opening 84 defined by housing wall 56.

A drive cable 86 is attached to opening 88 defined by arm 76. This cable extends to slot 90 defined in the wall 56 whereby the opposite end of the cable can be attached to any suitable actuating member. It is contemplated, for example, that the cable be secured to the end 16 of coin acceptor actuating member 12. Alternatively, a drive element engaged by the end 16 may be utilized. In any event, the drive cable 86 will pivot arm 76 whereby the aforementioned movement of support 50 can be achieved.

It will be understood that various changes and modifications may be made in the construction described which provide the characteristics of the invention without departing from the spirit thereof particularly as defined in the following claims.

That which is claimed is:

1. In a machine of the type providing for the vending of goods or services upon the insertion of a check into the machine, said machine including vending actuating means operable only upon the insertion of checks of a predetermined value, a supply of tickets, a ticket delivery position, ticket dispensing means associated with the machine whereby a ticket is dispensed by the machine in addition to said vending, and a housing for said ticket dispensing means, the improvement wherein said ticket dispensing means includue first pawl means for feeding said tickets one at a time to said delivery position, a drive for said first pawl means, means operatively connecting said drive to said actuating means whereby said first pawl means will feed a ticket of the delivery position only when checks of said predetermined value have been inserted in said machine, said drive reciprocating said first pawl means from a starting position to a driving position and then back to the starting position, said driving position being adjacent said delivery position, said feeding occurring during movement from the driving position to the starting position, and second pawl means located rearwardly of said starting position locking said strip against reverse movement as said first pawl means moves from the starting position to the driving position, said housing defining an opening at said delivery position whereby tickets are driven one at a time through said opening, each ticket being adapted to be torn away from said strip, said first pawl means being located at said delivery position rearwardly of said opening during tearing away of a ticket and operating to hold said strip against movement as each ticket is torn away, opposed plates mounted within said housing, said ticket strip being movable between said plates, one of said plates defining a baffle for directing said ticket strip outwardly of the housing, said ticket strip being directed over the edge of the other plate, and wherein said tickets are adapted to be removed one at a time from the strip by pulling the strip into engagement with said edge, said baffle defining a curved strip engaging surface directing the strip at substantially a right angle to the direction of movement of the strip during movement of said first pawl means from the driving position to the starting position.

2. A machine in accordance with claim 1 wherein said housing defines opposed walls, tracks defined by the opposed walls, and a support for said first pawl means movable along said track, and including means for pivotally mounting said second pawl means in a spaced position relative to said track.

3. A machine in accordance with claim 2 wherein said drive for said first pawl means comprises a pivotally mounted arm, and means connecting said arm to said support.

4. A machine in accordance with claim 3 including a solenoid having a reciprocating armature, said armature being attached to said arm for imparting pivoting movement to said arm.

5. In a machine of the type providing for the vending of goods or services upon the insertion of a check into the machine, said machine including vending actuating means operable only upon the insertion of checks of a predetermined value, a supply of tickets, a ticket delivery position, ticket dispensing means associated with the machine whereby a ticket is dispensed by the machine in addition to said vending, and a housing for said ticket dispensing means, the improvement wherein said ticket dispensing means include first pawl means for feeding said tickets one at a time to said delivery position, a drive for said first pawl means, means operatively connecting said drive to said actuating means whereby said first pawl means will feed a ticket to the delivery position only when checks of said predetermined value have been inserted in said machine, said drive reciprocating said first pawl means from a starting position to a driving position and then back to the starting position, said feeding occurring during movement from the driving position to the starting position, and second pawl means locking said strip against reverse movement as said first pawl means moves from the starting position to the driving position, said housing defining an opening at said delivery position whereby tickets are driven one at a time through said opening, each ticket being adapted to be torn away from said strip, said first pawl means operating to hold said strip against movement as each ticket is torn away, said housing defining opposed walls, tracks defined by the opposed walls, and a support for said first pawl means movable along said track, means pivotally mounting said second pawl means in a spaced position relative to said track, and wherein said drive for said first pawl means comprises a pivotally mounted arm, means connecting said arm to said support, and including a cable attached to said arm, means for pulling said cable to pivot said arm in one direction, and spring means associated with said arm for restoring said arm whereby said arm is adapted to reciprocate said support for said pawl means.

* * * * *